US007746008B2

(12) United States Patent
So

(10) Patent No.: US 7,746,008 B2
(45) Date of Patent: Jun. 29, 2010

(54) GROUP CONTROL TYPE FLUORESCENT, LED AND/OR HALIDE LIGHTING CONTROL SYSTEM

(76) Inventor: Yu-Sheng So, 3F., No. 12, Alley 5, Lane 120, Baogao Rd., Sindian City, Taipei County (TW)

( * ) Notice: Subject to any disclaimer, the term of this patent is extended or adjusted under 35 U.S.C. 154(b) by 520 days.

(21) Appl. No.: 11/849,295

(22) Filed: Sep. 2, 2007

(65) Prior Publication Data

US 2009/0058325 A1 Mar. 5, 2009

(51) Int. Cl.
*H05B 37/02* (2006.01)

(52) U.S. Cl. ..... 315/312; 315/317; 315/319

(58) Field of Classification Search ..... 315/312, 315/313, 314, 318, 319, 291, 317
See application file for complete search history.

(56) References Cited

U.S. PATENT DOCUMENTS

| | | | | |
|---|---|---|---|---|
| 7,358,684 | B2 * | 4/2008 | Wey et al. | 315/277 |
| 7,429,834 | B2 * | 9/2008 | Liu et al. | 315/307 |
| 2007/0152606 | A1 * | 7/2007 | Wey et al. | 315/274 |

* cited by examiner

*Primary Examiner*—David Hung Vu
(74) *Attorney, Agent, or Firm*—Ming Chow; Sinorica, LLC

(57) ABSTRACT

A group control type fluorescent, LED and/or halide lighting control system comprises at least a control interface, which generates a main control signal based on user's operation. This control interface is connected to one or more controllable driver to drive corresponding light sources according to the main control signal. The controllable drivers are cascaded to one or more drivers in order. These drivers control the connected light sources to produce corresponding actions according to control signals generated by the controllable drivers. Through a cascading design collocated with several controllable dimmable drivers, unlimited installation and immediate usage after installation can be accomplished without the need of any preset action. Moreover, the advantages of simple operation and easy learning can also be achieved.

13 Claims, 5 Drawing Sheets

GROUP CONTROL TYPE FLUORESCENT, LED AND/OR HALIDE LIGHTING CONTROL SYSTEM

BACKGROUND OF THE INVENTION

1. Field of the Invention

The present invention relates to a lighting equipment and, more particularly, to a group control type of fluorescent, LED and/or halide lighting control system of easy and convenient to assembly.

2. Description of Related Art

In addition to providing indispensable illumination or mood for life at night, lighting equipments also play an important role for work and commerce at daytime. Therefore, for office buildings and residence houses, the ideal illumination must include basic illumination, decorating illumination, and functional illumination.

Since the invention of electric lamps, various types of new light sources suitable to different places have been proposed. Regardless of fluorescent lamps, halide lamps or LED modules, wirings are laid out or reserved in advance based on different places for installation of lamps, especially for group control type lighting design. In general, if the group control type lighting design is a wired design, e.g., European Digital Addressable Lighting Interface (DALI), each controlled light source is usually coupled via an interface device so that it can be controlled by user. Therefore, it is necessary to extend the wiring from the control switch through the interface device to the location where the light source is located. The farther from the control switch a light source is, the longer the wiring. Moreover, because too long wiring causes too much noise, some repeaters are usually required to enhance the strength of signal, hence complicating the installation and wasting much wiring. For today's users, this job is too huge and very inconvenient, and material consumption and manpower expenditure required for the installation will lead to a substantial increase of cost. On the other side, if the group control type lighting design is a wireless design, although the wiring can be saved, it is necessary to perform setting actions for signal mating before use. Users have to learn complicated setting procedures in advance before use, hence causing much inconvenience.

Accordingly, the present invention aims to propose a group control type fluorescent, LED and/or halide lighting control system, which makes use of a cascading manner to achieve the advantages of saving of wiring and easy operation so as to effectively improve the above drawbacks in the prior art.

SUMMARY OF THE INVENTION

An object of the present invention is to provide a group control type fluorescent, LED and/or halide lighting control system, in which only a set of parallel/series wiring is required in the same control loop, hence effectively saving the wiring length and installation. Moreover, at least a controllable dimmable driver can be collocated in the series wiring to cascade more lamps.

Another object of the present invention is to provide a group control type lighting control system, which can be immediately used after installation without the need of any preset action. Therefore, users need not to learn complicated usage setting. The advantages of simple operation and easy learning can thus be achieved.

Yet another object of the present invention is to provide a group control type fluorescent, LED and/or halide lighting control system, in which repeaters, controllers or control signal amplifiers required in the prior art are saved, and no wiring for them is necessary. Therefore, the original decoration won't be destroyed, and existent control device and expenditure can also be reduced.

To achieve the above objects, the present invention provides a group control type fluorescent, LED and/or halide lighting control system, which comprises at least one control interface, at least one first controllable driver, and at least one first driver. The control interface generates a main control signal to the first controllable driver. The first controllable driver receives the main control signal and produces a corresponding action to drive a first light source. The first controllable driver also generates a first control signal. The first driver is cascaded to the first controllable driver. The first driver produces a corresponding action according to the first control signal to drive a second light source.

Moreover, at least one second controllable driver can further be connected to the control interface or the first driver to receive the main control signal or the first control signal to produce a corresponding action and also generate a second control signal for controlling the actions of a plurality of second drivers. In this way, the number of installed light sources can be continuously increased with no limit.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

The present invention provides a group control type fluorescent, LED and/or halide lighting control system, in which only a set of parallel/series wiring is required in the same control loop, hence effectively saving the wiring length and installation. Moreover, at least one controllable driver can be collocated in the series wiring to cascade more light sources.

The group control type lighting control system of the present invention comprises at least one control interface, which is the interface controlled by user. The control interface can be a common transfer switch, a control panel, a remote controller, a knob switch, a touch switch, a voice control switch, a computer or a portable electronic device. The portable electronic device can be a mobile phone or a PDA. This control interface bases on the operation of user to generate a main control signal of digital form or analog form. This control interface connects one or several first controllable drivers, which drive a first light source according to the main control signal. The first controllable driver is cascaded to one or several first drivers in order. The first driver controls the action of a second light source according to a first control signal generated by the first controllable driver. The number and type of controllable driver, driver and light source used in the present invention differ according to user's requirement.

For instance, the driver can be selected among dimmable electronic ballast, dimmable electronic transformer, and LED module driver. The technical features of the present invention will be illustrated in detail below based on different types of driver.

Figure 1:
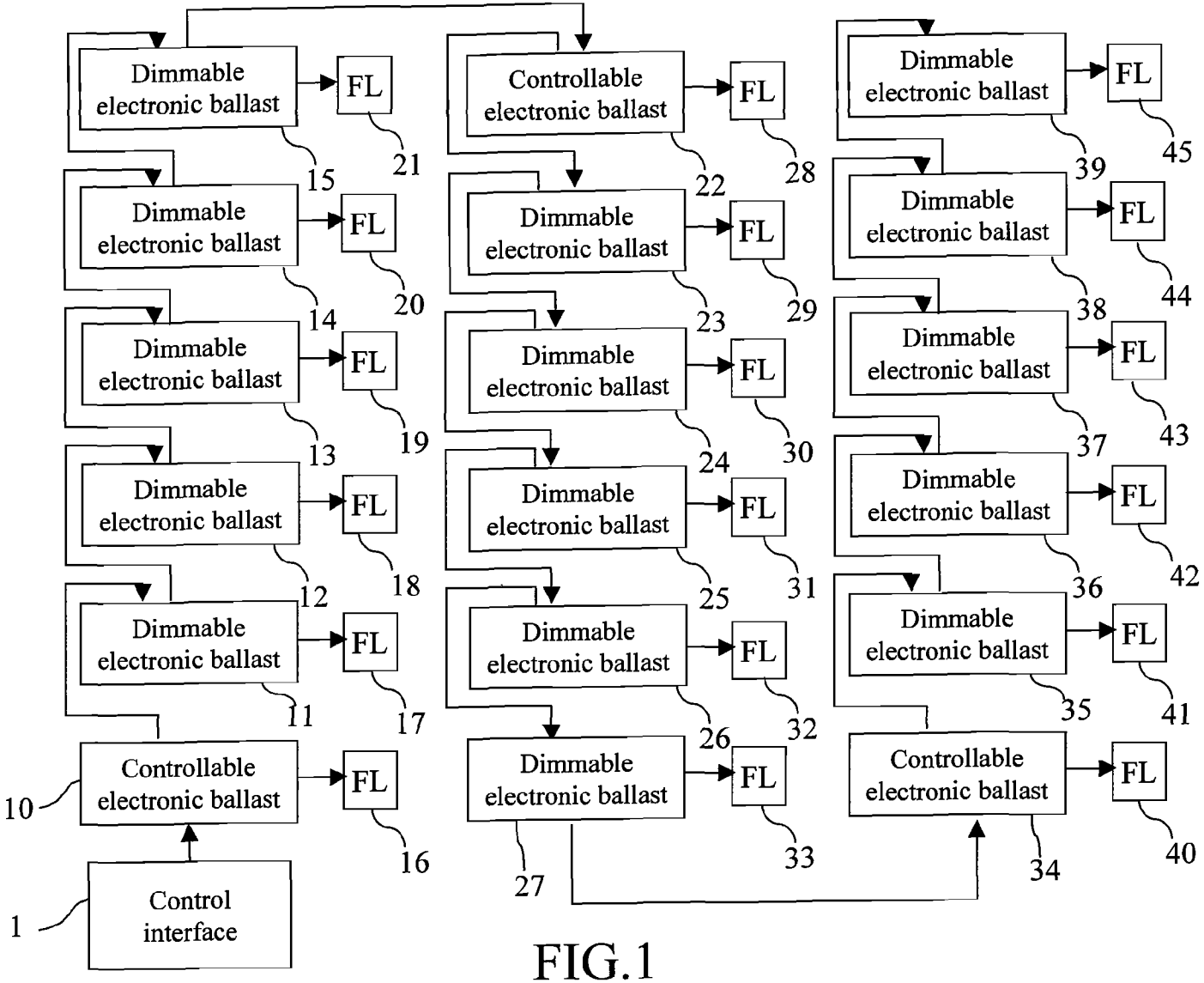
FIG. 1 is a block diagram of a group control type white lighting of the present invention.

If the controllable electronic driver is a controllable dimmable electronic ballast, then the light source will be a fluorescent lamp. As shown in FIG. 1, a control interface 1 is first connected to a controllable electronic ballast 10 having a dimming function. The controllable electronic ballast 10 drives a fluorescent lamp 16. This controllable electronic ballast 10 is then cascaded to dimmable electronic ballasts 11-15 in order. The dimmable electronic ballasts 11-15 are connected to fluorescent lamps 18-21 for driving them, respectively. A controllable electronic ballast 22 is connected to the dimmable electronic ballast 15 and drives a fluorescent lamp 28. This controllable electronic ballast 22 is then cascaded to dimmable electronic ballasts 23-27 in order. The dimmable electronic ballasts 23-27 are connected to fluorescent lamps 29-33 for driving them, respectively. The dimmable electronic ballast 27 at the distal end can further be extended to connect a controllable electronic ballast 34 for driving a fluorescent lamp 40. This controllable electronic ballast 34 is then cascaded to dimmable electronic ballasts 35-39 in order. The dimmable electronic ballasts 35-39 are connected to fluorescent lamps 41-45 for driving them, respectively. After the control interface 1 sends out a main control signal, the controllable electronic ballast 10 controls the action (e.g., turning-on, brightness adjustment, turning-off or illuminance memory control) of the fluorescent lamp 16 according to the main control signal, and simultaneously sends out a first control signal to the dimmable electronic ballasts 11-15 and the controllable electronic ballast 22 in order, letting the fluorescent lamps 17-21 and 28 produce corresponding actions. The controllable electronic ballast 22 generates a second control signal according to the first control signal, and sends out the second control signal to the dimmable electronic ballasts 23-27 and the controllable electronic ballast 34 in order, letting the fluorescent lamps 29-33 and 40 produce corresponding actions. The controllable electronic ballast 34 then generates a third control signal according to the second control signal, and sends out the third control signal to the dimmable electronic ballasts 35-39 in order, letting the fluorescent lamps 41-45 produce corresponding actions. Of course, it is feasible that the main control signal sent out by the control interface 1 drives only one group (e.g., only driving the controllable electronic ballast 22 and the dimmable electronic ballasts 23-27 to turn on or off the fluorescent lamps 28-33 in sections). Although this embodiment is exemplified with three groups, more groups can be added in the present invention. Moreover, all of the first control signal, the second control signal and the third control signal are digital serial signals.

Figure 2:
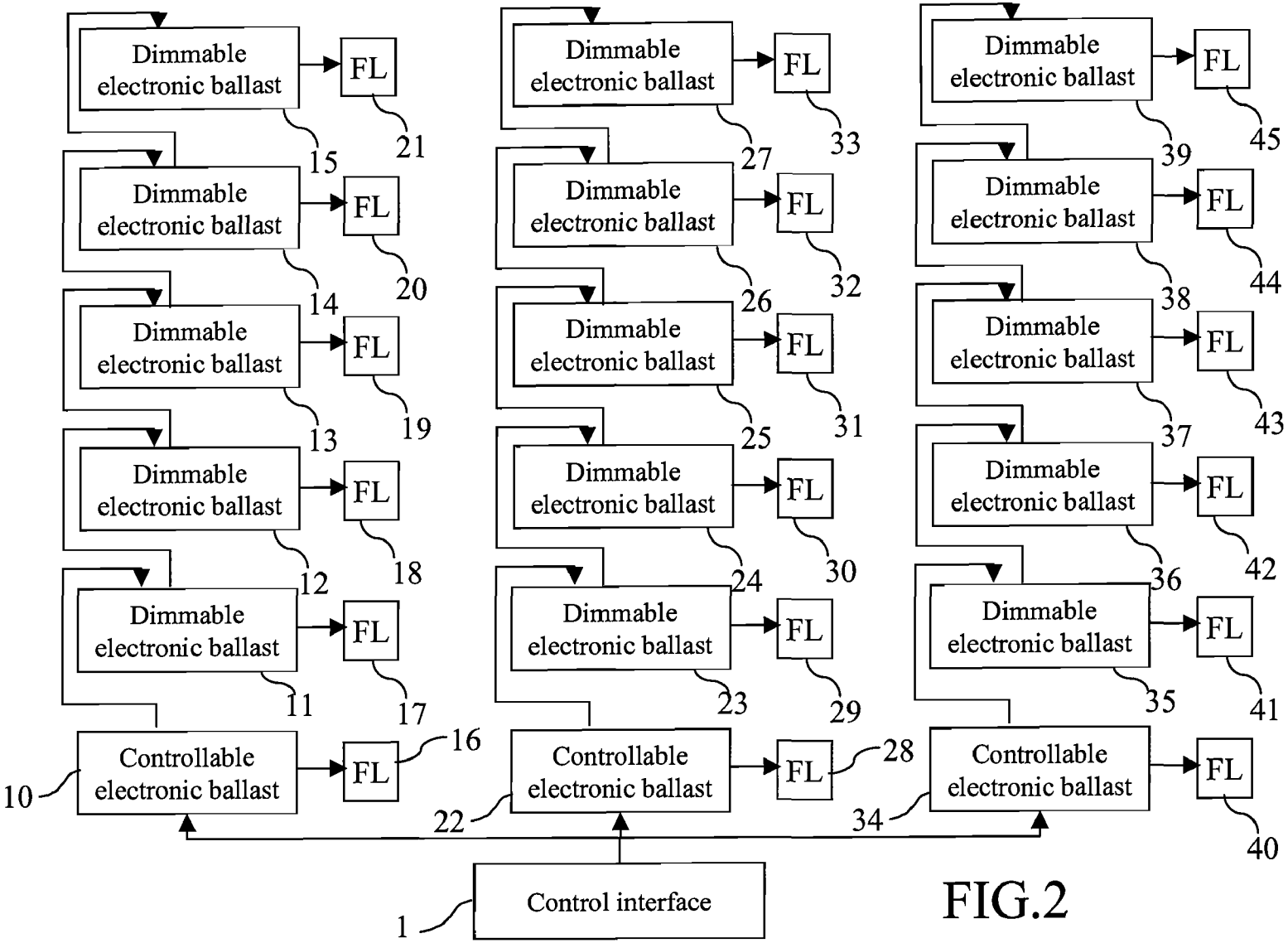
FIG. 2 is a block diagram of another group control type white lighting of the present invention.

In addition to the connection manner of FIG. 1, several controllable electronic ballasts can be directly connected to the control interface, as shown in FIG. 2. The control interface 1 is connected to the controllable electronic ballast 10, the controllable electronic ballast 22 and the controllable electronic ballast 34 and uses the main control signal to control them all. The controllable electronic ballast 10 bases on the main control signal to send out a first control signal to the dimmable electronic ballasts 11-15 so as to drive the fluorescent lamps 17-21. The controllable electronic ballast 22 bases on the main control signal to send out a second control signal to the dimmable electronic ballasts 23-27 so as to drive the fluorescent lamps 29-33. Similarly, the controllable electronic ballast 34 bases on the main control signal to send out a third control signal to the dimmable electronic ballasts 35-39 so as to drive the fluorescent lamps 41-45. Certainly, these three groups can be simultaneously or separately driven to act, and the dimmable electronic ballasts in each group can also be separately driven to act, all depending on the main control signal.

In the above two embodiments with different connection manners, dimmable electronic ballasts can be replaced with dimmable electronic transformer, and fluorescent lamps can be replaced with halide lamps or tungsten lamps; or dimmable electronic ballasts can be replaced with LED module controllers, and fluorescent lamps can be replaced with LED modules. No matter which kind of driver and light source are used, the same effect can be achieved.

Figure 3:
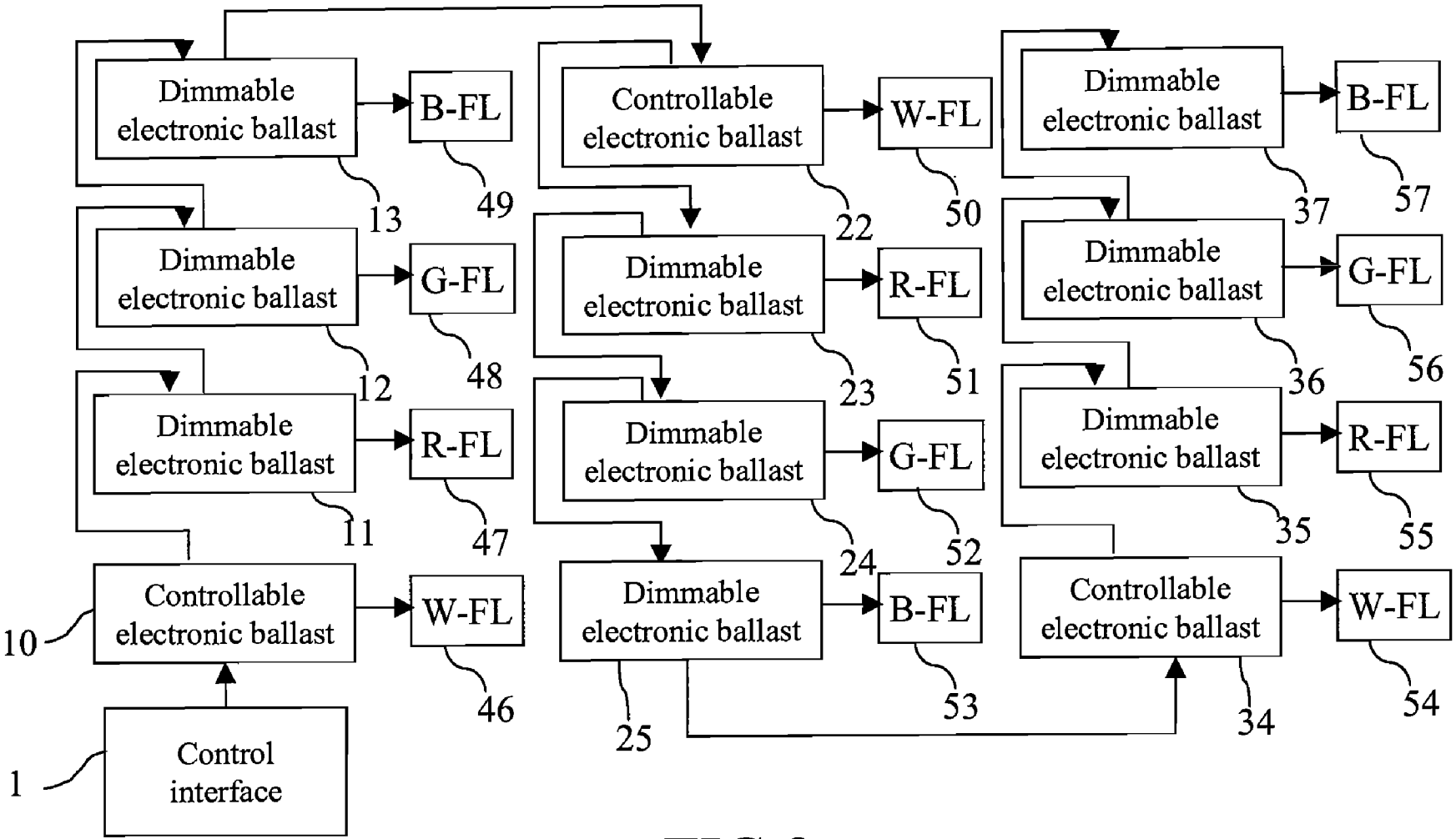
FIG. 3 is a block diagram of a group control type color lighting of the present invention.
Figure 4:
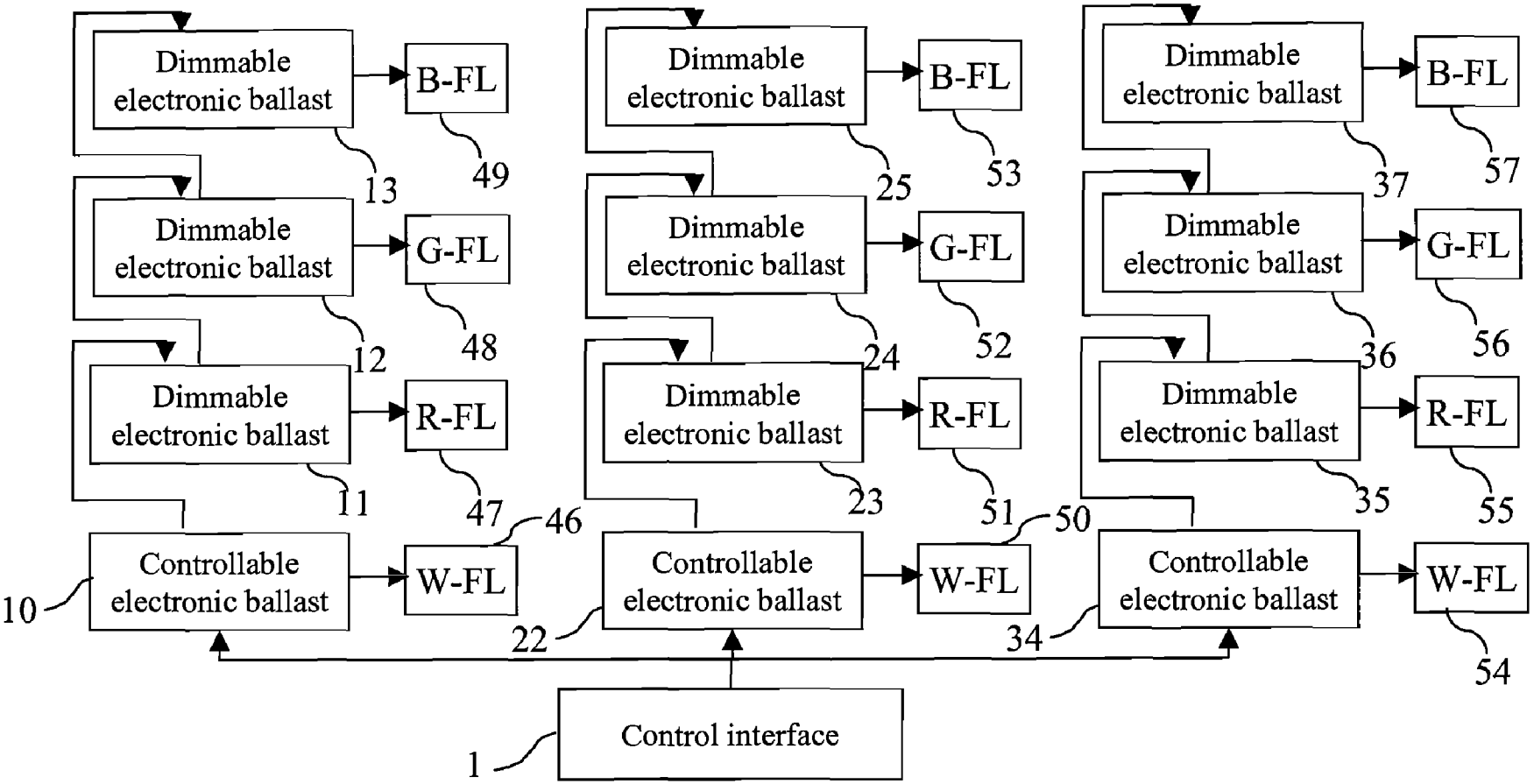
FIG. 4 is a block diagram of another group control type color lighting of the present invention.

The present invention can also be expanded to become a small-area or large area color lighting control system, as shown in FIGS. 3 and 4. The connection wiring architecture of FIG. 3 is the same as that of FIG. 1, while the connection wiring architecture of FIG. 4 is the same as that of FIG. 2. They only differ in light sources. As shown in FIG. 3, a controllable electronic ballast 10 is connected to a white lamp 46 to drive it, a dimmable electronic ballast 11 is connected to a red lamp 47 to drive it, a dimmable electronic ballast 12 is connected to a green lamp 48 to drive it, and a dimmable electronic ballast 13 is connected to a blue lamp 49 to drive it. A controllable electronic ballast 22 is connected to a white lamp 50 to drive it, a dimmable electronic ballast 23 is connected to a red lamp 51 to drive it, a dimmable electronic ballast 24 is connected to a green lamp 52 to drive it, and a dimmable electronic ballast 25 is connected to a blue lamp 53 to drive it. Similarly, a controllable electronic ballast 34 is connected to a white lamp 54 to drive it, a dimmable electronic ballast 35 is connected to a red lamp 55 to drive it, a dimmable electronic ballast 36 is connected to a green lamp 56 to drive it, and a dimmable electronic ballast 37 is connected to a blue lamp 57 to drive it. The rest may be deduced by analogy. In this way, through the main control signal of the control interface 1 collocated with control signals of the controllable electronic ballasts 10, 22 and 34, lighting combinations of varying color light sources can be achieved to have the functions of dimming control and brightness adjustment.

Figure 5:
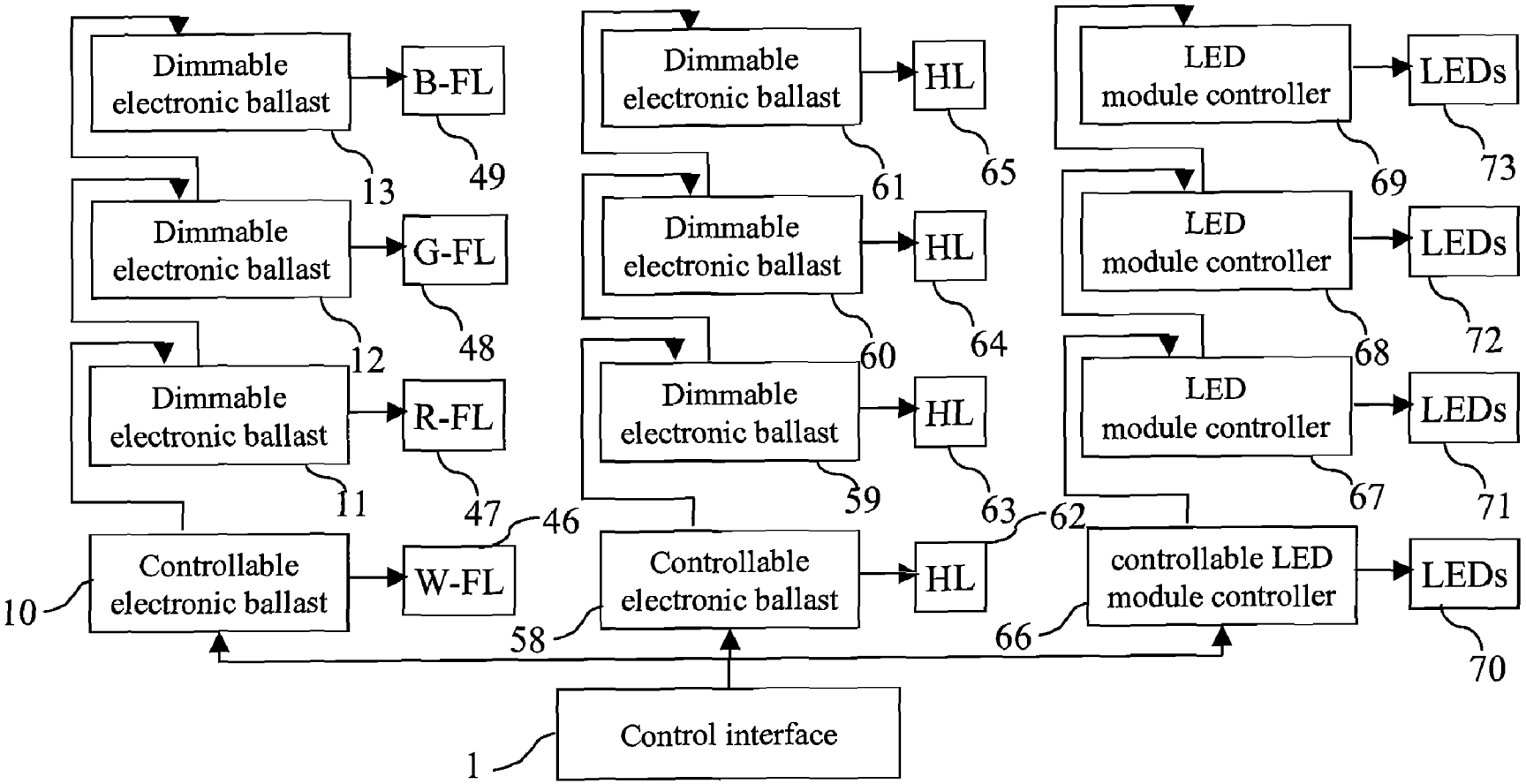
FIG. 5 is a block diagram of a group control type lighting that integrate multiple light sources of the present invention.

Furthermore, the present invention is not limited to the type of light source, and many kinds of light sources can be used. As shown in FIG. 5, the control interface 1 is connected to a controllable electronic ballast 10 and dimmable electronic ballasts 11-13 to control and drive a white lamp 46, a red lamp 47, a green lamp 48 and a blue lamp 49, respectively. Besides, the control interface 1 can be cascaded in turn to a controllable electronic transformer 58 and dimmable electronic transformers 59-61 that are controlled by the controllable electronic transformer 58 to drive halide lamps 62-65, respectively. Of course, the control interface 1 can also be connected to a controllable LED module controller 66 and LED module controllers that are cascaded to the controllable LED module controller 66 to drive LED modules 70-73, respectively. By using this system architecture, multi-light-source lighting system with sectional control can be achieved to satisfy the multifunction demand of dimming control or brightness adjustment.

All of the controllable drivers of the present invention have the functions of receiving and transmitting signals. Collocated with drivers with the receiving function, light sources can be cascaded with no limit, hence being very convenient. Besides, the control interface can transmit the main control signal by means of wired transmission, wireless signal, IR signal, or voice control signal, hence having a very wide application range.

To sum up, because the wiring used in the present invention features a two-line design: a common ground line and a signal line. It is only necessary for a user to plug the driver and then connect these two lines to complete the installation. Moreover, this signal line is used to transmit a digital serial signal, which is used as a control signal between a controllable driver and a driver or between drivers. Because the present invention can be immediately used after installation without the need of any preset actions, users need not to learn complicated usage setting. The advantages of simple operation and easy learning can thus be achieved. Moreover, repeaters, controllers or control signal amplifiers required in the prior art can be saved, and no wiring for them is necessary. Therefore, the original decoration won't be destroyed, and existent control device and expenditure can also be reduced.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A group control type fluorescent, LED and/or halide lighting control system comprising:

at least one control interface capable of generating a main control signal;

at least one first controllable driver for driving a first light source, said first controllable driver receiving said main control signal to produce a corresponding action and also generate a first control signal; and at least one first driver cascaded to said first controllable driver, said first driver producing a corresponding action according to said first control signal to drive a second light source.

2. The group control type fluorescent, LED and/or halide lighting control system as claimed in claim 1, wherein said first driver is further cascaded to a plurality of drivers in order, and said drivers produce a corresponding action respectively according to said first control signal.

3. The group control type fluorescent, LED and/or halide lighting control system as claimed in claim 1 further comprising at least one second controllable driver, wherein said second controllable driver is connected to said first driver and receives said first control signal to produce a corresponding action and also generate a second control signal for controlling a plurality of second drivers that are cascaded to said second controllable driver.

4. The group control type fluorescent, LED and/or halide lighting control system as claimed in claim 1 further comprising at least one second controllable driver, wherein said second controllable driver is connected to said control interface and receives said main control signal to produce a corresponding action and also generate a second control signal for controlling a plurality of second drivers that are cascaded to said second controllable driver.

5. The group control type fluorescent, LED and/or halide lighting control system as claimed in claim 1, wherein said first controllable driver is selected among dimmable electronic ballast, dimmable electronic transformer, and LED module controller, and if said first controllable driver is an electronic transformer, said first light source is a halide lamp or a tungsten lamp, and if said first controllable driver is an LED module controller, said first light source is an LED module.

6. The group control type lighting control system as claimed in claim 5, wherein said first driver and said first controllable driver are of the same type.

7. The group control type fluorescent, LED and/or halide lighting control system as claimed in claim 3, wherein said second controllable driver is selected among dimmable electronic ballast, dimmable electronic transformer, and LED module controller, and if said second controllable driver is an electronic transformer, it is used to drive a halide lamp or a tungsten lamp, and if said second controllable driver is an LED module controller, it is used to drive an LED module.

8. The group control type fluorescent, LED and/or halide lighting control system as claimed in claim 7, wherein said second driver and said second controllable driver are of the same type.

9. The group control type fluorescent, LED and/or halide lighting control system as claimed in claim 4, wherein said second controllable driver is selected among dimmable electronic ballast, dimmable electronic transformer, and LED module controller, and if said second controllable driver is an electronic transformer, it is used to drive a halide lamp or a tungsten lamp, and if said second controllable driver is an LED module controller, it is used to drive an LED module.

10. The group control type fluorescent, LED and/or halide lighting control system as claimed in claim 9, wherein said second driver and said second controllable driver are of the same type.

11. The group control type fluorescent, LED and/or halide lighting control system as claimed in claim 1, wherein said control interface transmits said main control signal by means of wired transmission, wireless signal, IR signal, or voice control signal.

12. The group control type fluorescent, LED and/or halide lighting control system as claimed in claim 2, wherein said first light source driven by said first driver and a plurality of light sources driven by said drivers are selected among white light source, red light source, blue light source and green light source to produce corresponding actions.

13. The group control type fluorescent, LED and/or halide lighting control system as claimed in claim 1, wherein said control interface is a control panel, a remote controller, a transfer switch, a knob switch, a touch switch, a voice control switch, a computer or a portable electronic device.

* * * * *